US005152258A

United States Patent [19]

D'Alfonso

[11] Patent Number: 5,152,258

[45] Date of Patent: Oct. 6, 1992

[54] HYDRAULIC CONTROL DEVICE FOR POPPET VALVES OF COMBUSTION ENGINES

[75] Inventor: Nunzio D'Alfonso, Nuremberg, Fed. Rep. of Germany

[73] Assignee: MAN Nutzfahrzeuge AG, Munich, Fed. Rep. of Germany

[21] Appl. No.: 621,311

[22] Filed: Nov. 30, 1990

[30] Foreign Application Priority Data

Dec. 2, 1989 [DE] Fed. Rep. of Germany ..... 3939934

[51] Int. Cl.[5] ..... F01L 9/02

[52] U.S. Cl. ..... 123/90.12

[58] Field of Search ..... 123/90.12, 90.15

[56] References Cited

FOREIGN PATENT DOCUMENTS 594121 3/1960 Canada ..... 123/90.12
3115423 11/1982 Fed. Rep. of Germany .
259713 12/1985 Japan ..... 123/90.12
2027486 2/1980 United Kingdom ..... 123/90.12

*Primary Examiner*—Noah P. Kamen
*Attorney, Agent, or Firm*—Robert W. Becker & Associates

[57] ABSTRACT

The present invention relates to a hydraulic control device for poppet valves of combustion engines. In order to increase the braking power of combustion engines it is desirable to vary the poppet valve opening times independent of the movement of the cam. According to the present invention a connecting line is provided between the cam input piston that is actuated by the cam and the valve-actuating piston of the poppet valve. A further control line is branched off that connecting line and leads to a control unit which opens or closes the connection between the control line and the recycling line. The cam input piston itself may serve as the control piston and also open or close the connecting line to the recycling line in order to open and close the poppet valve.

11 Claims, 6 Drawing Sheets

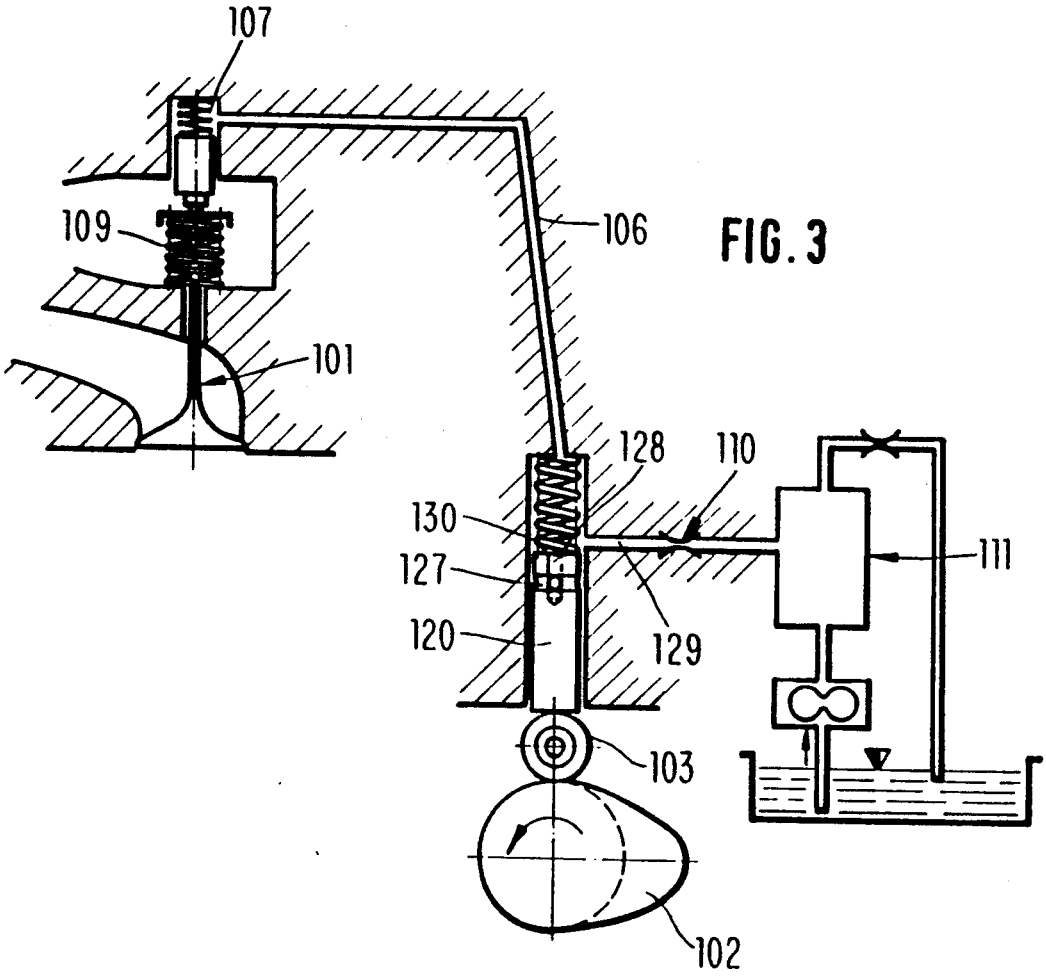
FIG. 3
FIG. 3a
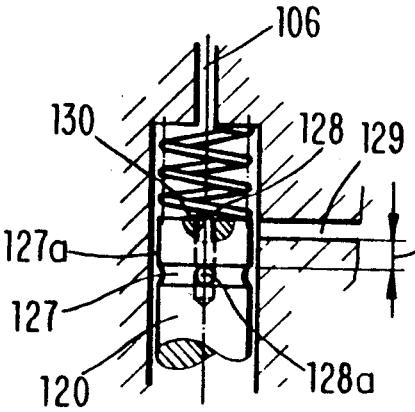
FIG. 3b
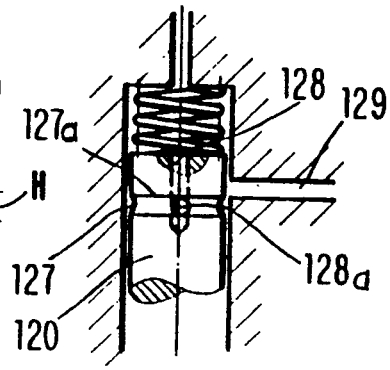

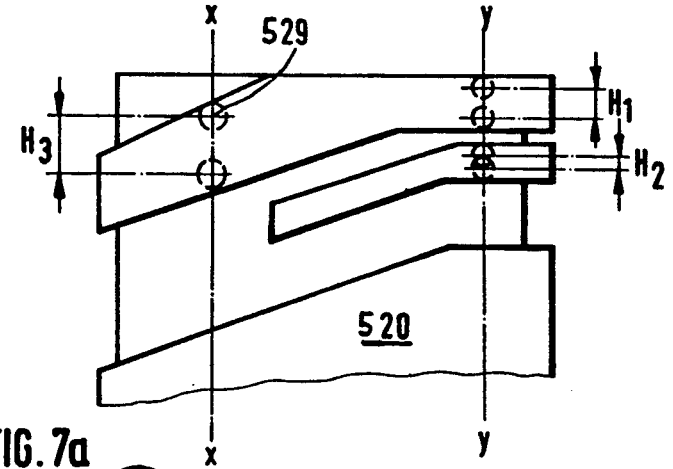
FIG. 7
FIG. 7a
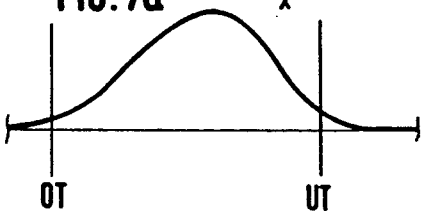
FIG. 7b
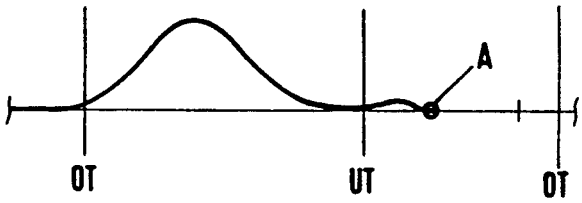
FIG. 8a
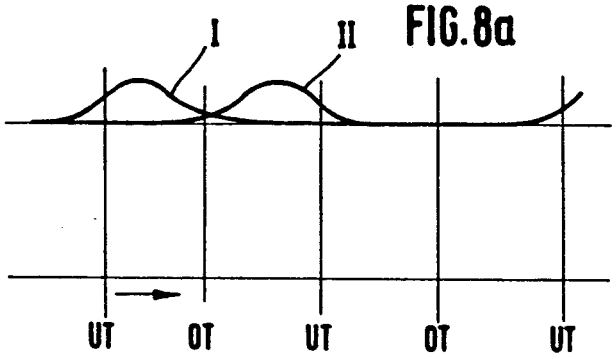
FIG. 8
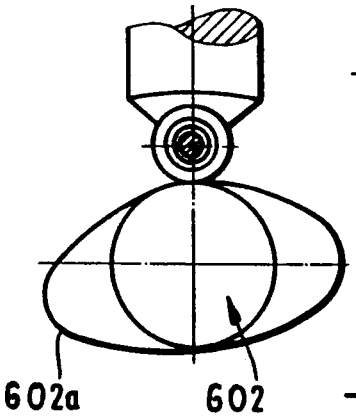
FIG. 8b
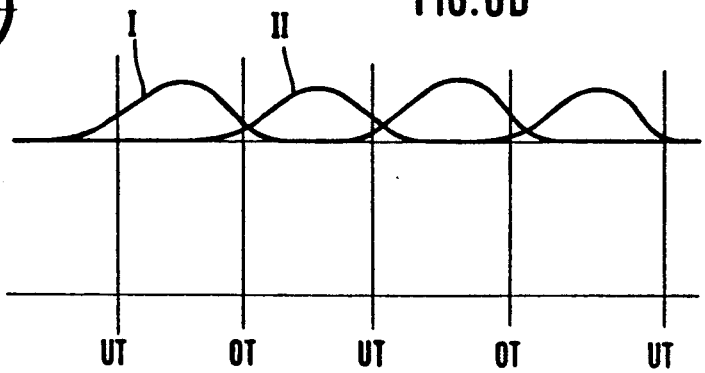

HYDRAULIC CONTROL DEVICE FOR POPPET VALVES OF COMBUSTION ENGINES

BACKGROUND OF THE INVENTION

1. Field of the Invention

The present invention relates to a hydraulic control device for poppet valves of combustion engines, comprising a valve with a valve spring and a hydraulic closed system, that is formed by a cam input cylinder and a valve-actuating cylinder which are connected by a connecting line, wherein a cam input piston guided in the cam input cylinder is actuated by a cam and a valve-actuating piston guided in the valve-actuating cylinder is functionally connected to the valve, and further comprising a main lubricating device which is connected in parallel to the hydraulic closed system via a relief valve.

2. Description of the Prior Art

A poppet valve for combustion engines, which may be opened by a hydraulic valve-actuating piston and closed by a valve spring, has been known from DE-OS 31 15 423. The valve-actuating piston is actuated by the hydraulic fluid via a cam input cylinder which is engaged by a cam, whereby the cam input cylinder of the cam input piston is connected to the valve-actuating cylinder of the valve-actuating piston via a connecting duct. In order to compensate for oil leakage, the hydraulic closed system, consisting of a cam input cylinder, a valve-actuating cylinder, and the connecting duct, is connected with a common main lubricating device. To avoid backflow of the hydraulic fluid, a relief valve is arranged between the hydraulic closed system and the main lubricating device.

A disadvantage of such a hydraulic valve control device is that the valve movement is rigidly coupled to the given movement of the cam.

It is therefore an object of the present invention to provide a valve control device being variable with respect to the movement imposed by the cam.

SUMMARY OF THE INVENTION

The hydraulic control device for gas-reversing or poppet valves of combustion engines of the present invention is primarily characterized by at least one control unit which is magnetically actuated and provided in a branch circuit of a connecting line, whereby the control unit shuts off the connecting line when the poppet valve is actuated, and opens the connecting line to a primary reservoir of a main lubricating device when the poppet valve is released.

Via a control unit that is magnetically actuated, the movement transferred by the cam to the cam input piston may be passed on to the poppet valve or may be interrupted, so that the valve movement is more independent from the movement imposed by the cam.

In a preferred embodiment the control unit comprises a control piston and a control cylinder, whereby the control piston is connected to a solenoid, and the control cylinder is connected, in its middle section, via a control line to a connecting line and via a recycling line to a primary reservoir: the cylinder volume on the top and the bottom of the control piston communicate with one another via a compensating line and a restriction: the control piston has a annular slot that communicates with a central bore of the control piston, whereby the central bore opens into a pressure chamber such that, via the annular slot and the central bore, a connection of the control line and the recycling line is created when the valve is not actuated and the connection is interrupted when the valve is actuated.

The movement imposed onto the valve-actuating cylinder of the valve by the cam via the cam input piston may be interrupted due to the magnetically actuatable control piston by opening the pressure chamber as often as desired and at any time chosen.

In a further embodiment two identical control units are provided whereby a second control unit is connected, in parallel with a first control unit, to the connecting line via a second control line; each control unit is connectable to the recycling line via a respective restriction; the respective solenoids of the control units are independently actuatable, whereby the first control unit serves to open the poppet valve and the second control unit serves to close the poppet valve.

The opening and the closing of the poppet valve may be controlled independently due to the two magnetically actuatable control pistons, thereby further improving the variability of the movement of the poppet valve.

In another embodiment the cam input piston serves as the control piston and is provided with a control slot which is connectable via a connecting means, for example, in the form of a bore, of the control piston to a release bore of the cam input cylinder. The release bore opens to the main lubricating device; the poppet valve is actuated when the bottom of the control piston passes the release bore, and the poppet valve is released when the control slot passes the release bore.

When the requirements for controlling the movement of the poppet valve in a timewise manner are not extremely high, i.e., when the timing may remain constant during the entire operation of the engine, this embodiment provides an inexpensive but yet highly effective control device.

In a further embodiment the control slot of the control piston is slanted in the shape of a helical thread and has a slanted control edge, whereby the control slot does not extend over the entire circumference; the part of the control piston comprising the control slot corresponds to a full piston diameter and the part of the control piston not comprising the control slot has a smaller diameter; the control piston is also adjustable via a rotating mechanism.

The slanted control slot may interrupt the poppet valve actuation in a timely variable manner.

If it is desired to interrupt the poppet valve actuation twice this may be achieved by providing at least two control slots at the control piston, whereby the first and second control slots are in the shape of a helical thread and the control slots may have different slants; or by providing a control piston having a first and a second control edge, whereby the second control edge is disposed at the control slot and the edges may have different slants.

A design for the rotating mechanism of the control piston in the control cylinder comprises the cam input cylinder which is arranged in a housing in a fixed manner and has a portion facing the cam, whereby the portion is enclosed by a revolving casing 35, that is connected in a non-rotatable but slidable manner via a square end of a piston rod to the control piston; the free end of the piston rod is frictionally connected to the roller shaft 3.

BRIEF DESCRIPTION OF THE DRAWINGS

This object, and other objects and advantages of the present invention, will appear more clearly from the following specification in conjunction with the accompanying drawings, in which:

FIG. 3 is a schematic representation of a hydraulic closed system for a hydraulic control device with a cam input piston functioning as the control piston;

FIG. 3*a* shows a detailed view of the control piston of FIG. 3 at the beginning of the poppet valve actuation;

FIG. 3*b* shows a detailed view of the control piston of FIG. 3 at the end of the poppet valve actuation;

FIG. 7 represents a variation of the control piston in a side view;

FIG. 7*a* is a qualitative representation of the valve lifting of an inlet valve as a function of the crank angle between the upper and the lower dead center position of a gas-reversing step;

FIG. 7*b* is a qualitative representation of the valve lifting of an inlet valve as a function of the crank angle between the upper dead center position of a gas-reversing step and the upper dead center position at the ignition point with a second valve lifting after the lower dead center position;

FIG. 8 shows a cam having a second cam lobe for controlling a motor brake;

FIG. 8*a* is a qualitative representation of the valve lifting of an inlet and outlet valve in a usual four-stroke cycle;

FIG. 8*b* is a qualitative representation of the valve lifting of an inlet and outlet valve during the motor braking mode;

DESCRIPTION OF PREFERRED EMBODIMENTS

The present invention will now be described in detail with the aid of several specific embodiments utilizing FIGS. 1–9.

Figure 1:
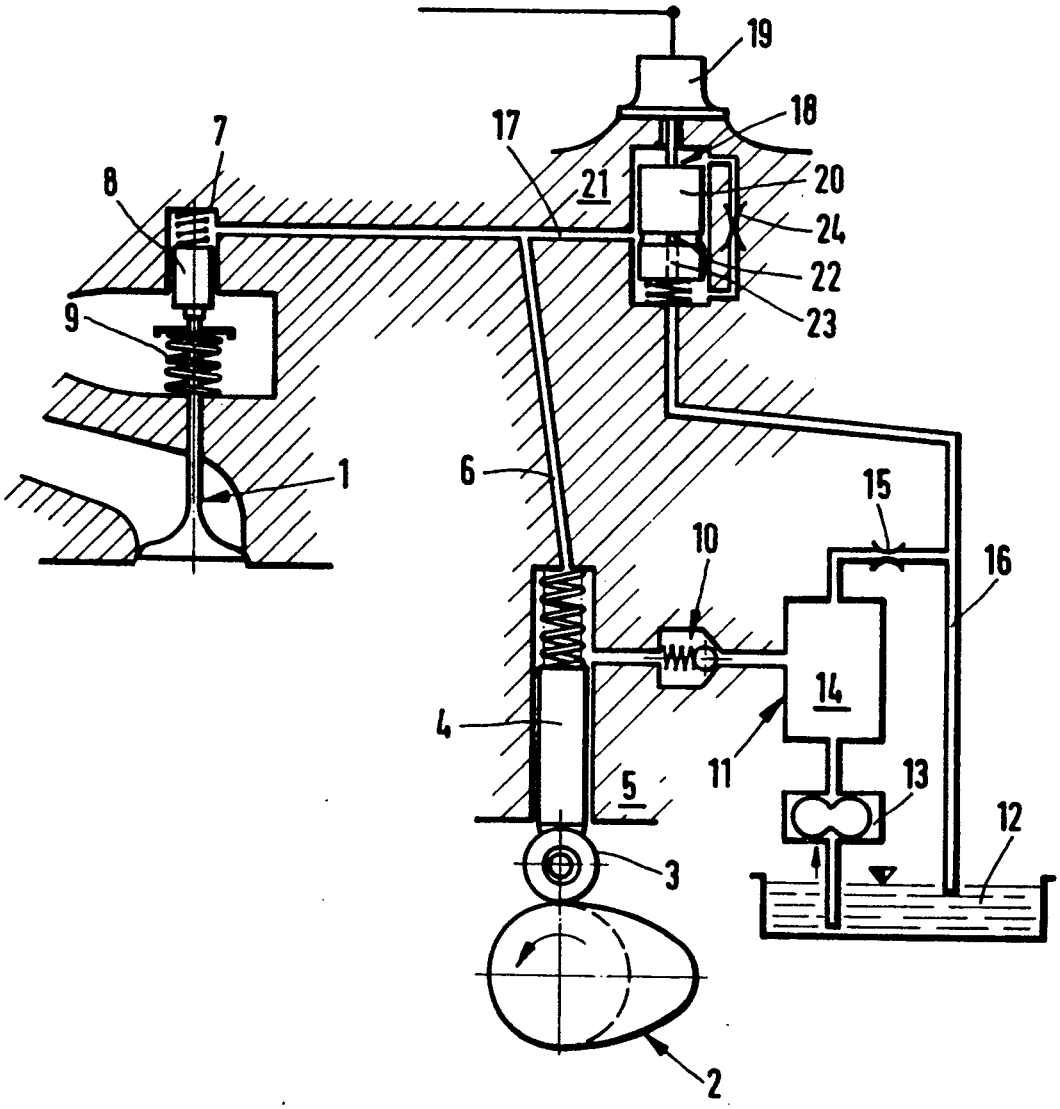
FIG. 1 is a schematic representation of a hydraulic closed system for a hydraulic control device with one control piston.
Figure 2:
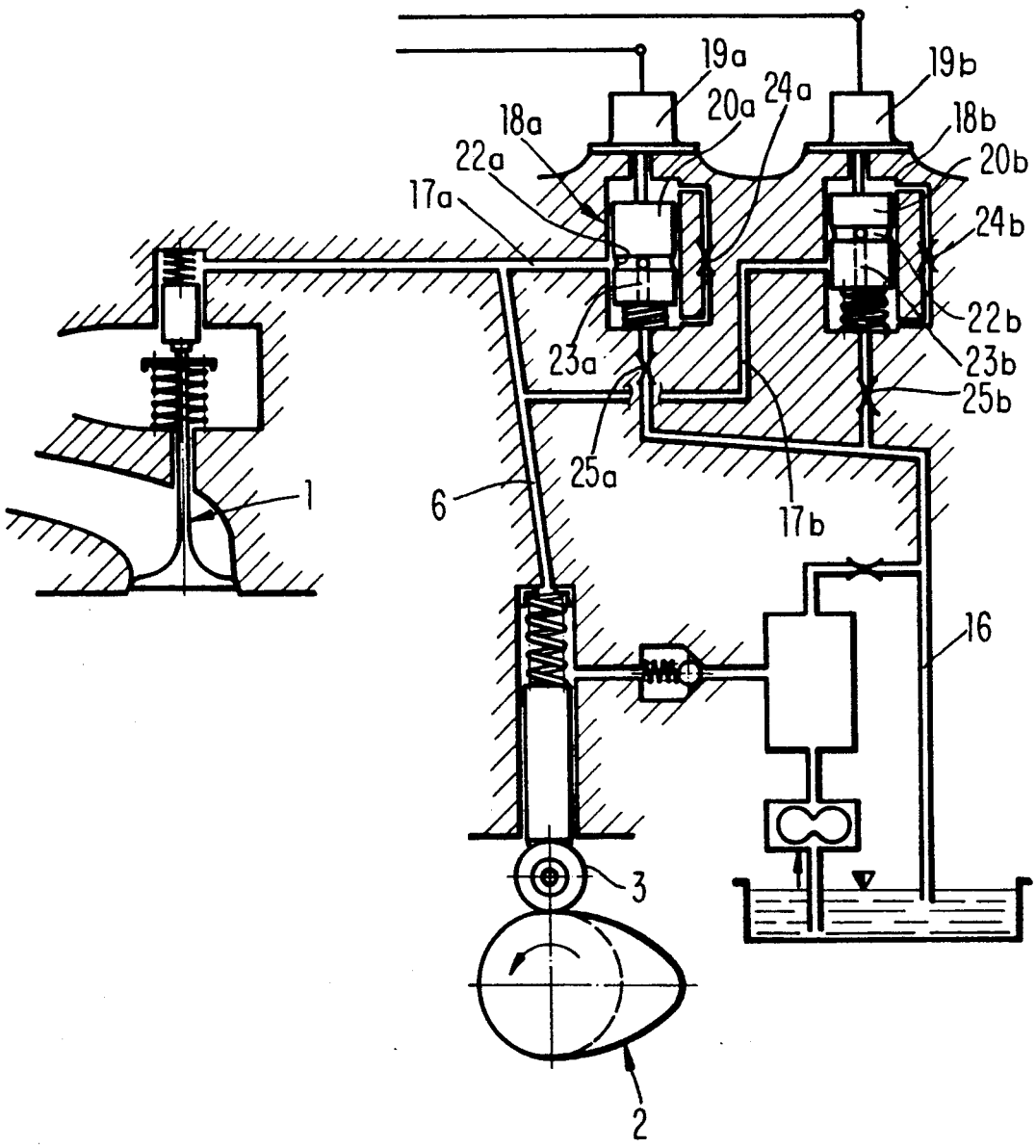
FIG. 2 is a schematic representation of a hydraulic closed system for a hydraulic control device with two control pistons.
Figure 9:
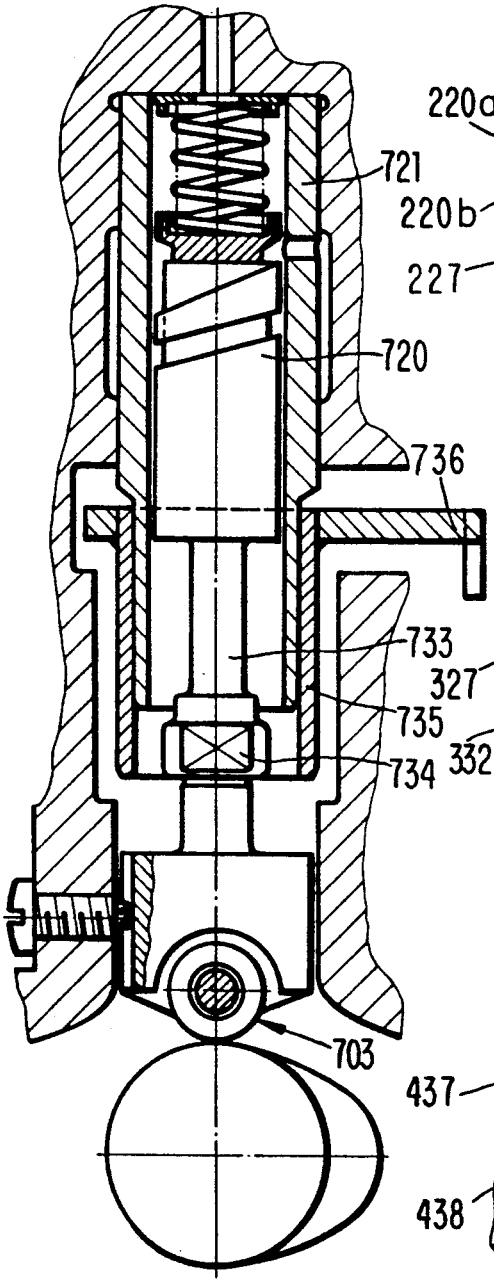
FIG. 9 shows a rotating mechanism of the control piston.

FIG. 1 represents one embodiment of a hydraulic control device for a poppet valve 1. For the controlling of the poppet valve 1 a hydraulic closed system is arranged between the poppet valve 1 and the cam input piston 4 which is actuated by a cam 2 that transfers its movement via a roller shaft 3 to the cam input piston 4. The cam input piston 4 is guided in a cam input cylinder 5, which is connected to the valve-actuating cylinder 7 via a connecting line 6. The valve-actuating piston 8 guided in the valve-actuating cylinder 7 is connected to the poppet valve 1. The poppet valve 1 is maintained in its closing position by the valve spring 9. In order to compensate for oil leakage, the cam input cylinder 5 is connected to a main lubricating device 11 via a relief valve 10. The main lubricating device 11, which is common in vehicles, comprises a primary reservoir 12 from which a pump 13 conveys the hydraulic fluid into a secondary reservoir 14. From there the hydraulic fluid is recycled into the primary reservoir 12 via a restriction 15 and a recycling line 16. The main lubricating device 11 usually corresponds to the lubricating system of the engine. The pump 13 is then identical to the lubricating oil pump of the engine and the primary reservoir 12 is identical to the main oil reservoir of the engine. According to the present invention, a control line 17 branches off the connecting line 6 and leads to a control unit 18, which is actuated by a solenoid 19. The actuation may also be achieved by electro-hydraulic or electro-pneumatic means. The solenoid 19 transfers its movement to the control piston 20 which is guided in a control cylinder 21. The control piston 20 is provided with an annular slot 22 and a central bore 23 which communicates with the annular slot 22. The two cylinder chambers are connected via a restriction 24.

The cam 2 engages the cam input piston 4 via the roller shaft 3. The movement of the cam input piston 4 is hydraulically transferred to the valve-actuating piston 8 via a connecting line 6 so that the poppet valve 1 is opened against the force of the valve spring 9. According to the invention, this opening step may take place only when the control piston 20 shuts off the control line 17. The opening step is interrupted when the control piston 20 is moved by the solenoid 19 to a position where the control line 17 is connected to the recycling line 16 via the annular slot 22 and the central bore 23. Thereby the pressure in the valve-actuating cylinder 7 is reduced and the valve 1 is closed. This step may be adjusted to any given requirements by exciting the solenoid 19. Of course, the solenoid 19 may be excited by an electronic device (represented in the drawing) so that the poppet valve control is independent from the movement of the poppet valve 1 that is imposed by the cam 2. The poppet valve movement may then be superimposed by the movement of the control piston 20 which is controlled by the electronic device.

A further variability of the poppet valve movement and a relief for the first control unit may be achieved by introducing a second control unit (FIG. 2) which is identical in its design and function to the first control unit. The second control line 17*b* connects in parallel the second control unit 18*b* to the connecting line 6. By closing the annular slot 22*a* and the central bore 23*a* of the first control unit 18*a* via the control line 17*a*, the poppet valve 1 may be opened, while by opening the second control line 17*b* via the central bore 23*b* of the second control unit 18*b* the closing of the poppet valve 1 may be actuated.

By combining the functions of the first and the second control unit 18*a* and 18*b*, a flexible timing of the poppet valve 1 is possible, which may not be achieved when the solenoids 19*a*, 19*b* and the respective control units 18*a*, 18*b* work independently, because of their sluggishness, especially, when the poppet valve 1 must be opened and closed more than once during a working cycle. The pressure chambers of the control units 18*a* and 18*b* are connected to one another via restrictions 24*a* and 24*b*, and the pressure chambers which are connected to the central bores 23*a* and 23*b* communicate with the recycling line 16 via restrictions 25*a* and 25*b*. Thereby the closing speed of the poppet valve 1 may be influenced or attenuated.

In the case that the requirements for influencing the movement of the poppet valve are not extremely high, and the movement must not be variable with respect to timing, the cam input piston itself may actually serve as the control piston. This further embodiment is represented in FIG. 3. In this case the cam input and control piston 120 is equipped with a control slot 127, which allows connecting the valve-actuating cylinder 107 of the poppet valve 101 to the main lubricating device 111 via the connecting line 106, the connecting means in the form of a bore 128 of the control piston 120, the control slot 127, and the restriction 110. With the control piston 120 in this position, the poppet valve 101 is closed by the pressure reduction in the connecting line 106 and the valve-actuating cylinder 107. The pressure in the main lubricating device 111 is not sufficient to open the poppet valve 101 against the force of the valve spring 109, so that, when the control slot 127 is released, the hydraulic fluid of the connecting line 106 flows back via the release bore 129 and the restriction 110. When the release bore 129 is closed, the pressure required for opening the poppet valve 101 may build up again. Details of the control piston 120 are shown in FIGS. 3*a* and 3*b*.

FIG. 3*a* shows the control piston 120 at the beginning of the pressure build-up. The pressure build-up in the connecting line 106 (FIG. 3) begins when the bottom 130 of the control piston 120 has passed the release bore 129. The pressure reduction may only begin when the edge 127*a* of the control slot 127 opens the path to the release bore 129 via the bore 128 and the transverse bore 128*a*. H represents the effective stroke. After traveling the distance H the opening step of the poppet valve 101 (FIG. 3) ends. The closing step of the poppet valve 101 is influenced by the pressure regulating effect of the release valve 129. The pressure regulation effect may be further influenced by incorporating an adjustable restriction 110 into the release valve 129.

The final stage of the pressure build-up is represented in detail in FIG. 3*b*. The edge 127*a* opens the path for the hydraulic fluid to the release valve 129 via the bore 128, the transverse bore 128*a*, and the control slot 127.

Figure 4:
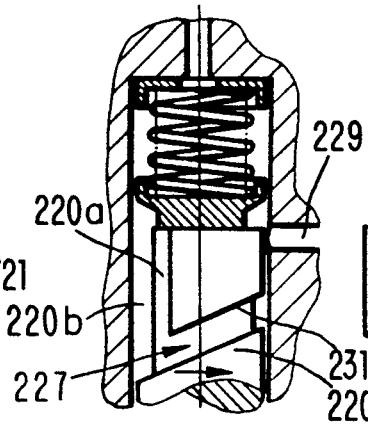
FIG. 4 shows a control piston with a slanted control slot.

The cam input piston itself may also be used as the control piston which allows a timely variation of the closing phase (FIG. 4). In this case, the control piston 220 is equipped with, for example, a control slot 227 that is slanted in the shape of a helical thread and has a slanted control edge 231. By rotating the control piston 220 the pressure reduction may be advanced or delayed. When rotated in the direction of the arrows in FIG. 4, the pressure reduction is delayed, when rotating it against the direction of the arrows it is advanced. When the control edge 231 has passed the release bore 229, the hydraulic fluid may flow into the release bore 229 via the connecting means in the form of a peripheral recess 220*b* created by the part 220*a* of a reduced diameter of the control piston 220 and via the control slot 227 (FIG. 4*b*).

Figure 4A:
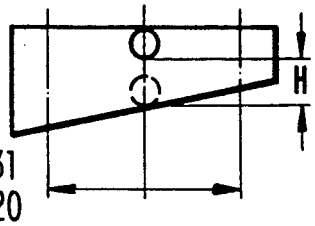
FIG. 4*a* is a side view of a control piston with a slanted control slot showing the effective stroke.
Figure 4B:
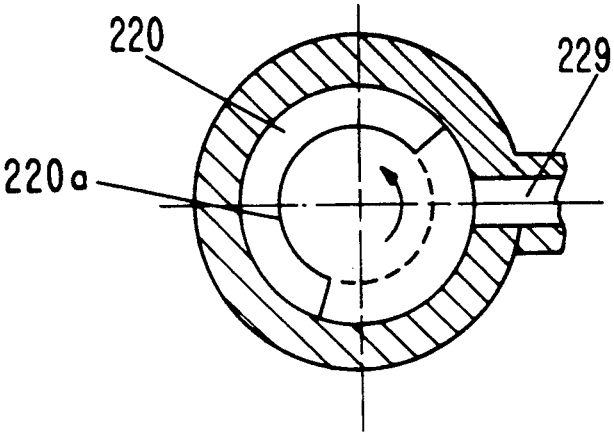
FIG. 4*b* is a cross-sectional view of the control piston of FIG. 4 at the release bore.

FIG. 4*a* shows the effective stroke H of the position of the control piston 220 as represented in FIG. 4.

Figure 5:
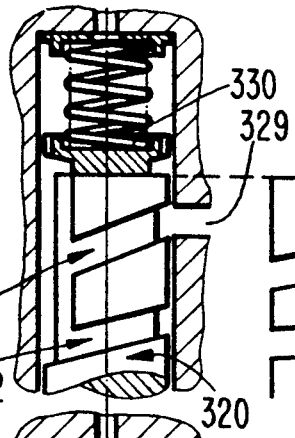
FIG. 5 shows a control piston with two control slots as the control member.

A variation of the control piston with two control slots 327 and 332 is represented in FIG. 5. The control slots 327, 332 may have different slants. The pressure build-up begins when the bottom 330 of the control piston passes the release bore 329. The first pressure reduction which causes the closure of the poppet valve begins when the first control slot 327 is opened to the release bore S29. Subsequently, a further opening step of the poppet valve occurs. When the control piston 320 is moved further, the passage for the hydraulic fluid to the release bore 329 via the second control slot 332 is opened, so that the poppet valve closes again.

Figure 5A:
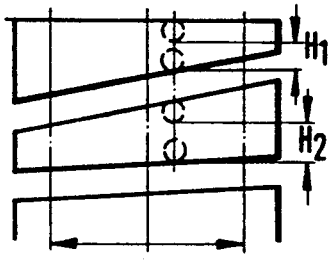
FIG. 5*a* is a side view of the control piston of FIG. 5 showing the effective stroke.

FIG. 5*a* shows the effective strokes $H_1$ and $H_2$ for two subsequent openings of the poppet valve. By rotating the control piston 320 (FIG. 5) and by selecting one of the varying shapes of the control slots, timings for the operation of the engine, including one and two poppet valve openings, may be optimized.

Figure 6:
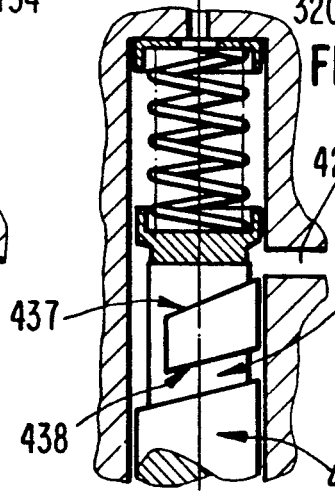
FIG. 6 shows a control piston with a slanted control edge and a control slot as the control member.

A further embodiment of the control piston is shown in FIG. 6. The control piston 420 is equipped with a first 437 and a second edge 438 of the control slot 427. The pressure build-up on top of the control piston 420 starts when the first control edge 437 passes the release bore 429. The closing of the poppet valve is induced when the second control edge 438 opens the passage for the hydraulic fluid into the release bore 429.

Figure 6A:
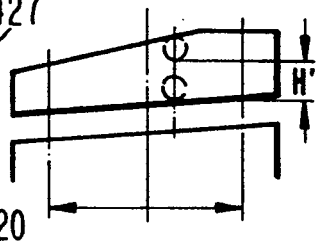
FIG. 6*a* is a side view of the control piston of FIG. 6 showing the effective stroke.

The developed projection of the control piston 420 according to FIG. 6 is represented in FIG. 6*a*. H' is the effective stroke.

FIG. 7 represents a special embodiment of the control piston shown in the form of a developed projection. According to this embodiment, it is possible to induce two subsequent liftings of the poppet valve for one lifting of the cam. This is desirable in some cases in order to increase the braking power of the engine.

The normal function with one lifting of the poppet valve is carried out when the relative position of the release bore 529 to the control piston 520 is along the axis x—x. The effective stroke of the control piston 520 is represented by the distance $H_3$.

The diagram of FIG. 7*a* corresponds to this position and is shown as a function of the crank angle.

A double lifting of the poppet valve takes place when the position of the release bore 529 relative to the control piston 520 is along the axis y—y (FIG. 7). The two subsequent liftings of the poppet valve are determined by the distances $H_1$ and $H_2$.

The diagram corresponding to two liftings of the poppet valve is represented in FIG. 7*b* as a function of the crank angle. The second lifting of the poppet valve after the gas-reversing lower dead center position (UT) is useful to avoid a final compression pressure that is two high in the case of a combustion engine under full load. To achieve this the inlet valve opens shortly after the gas-reversing lower dead center position and pushes air back into the air pressure line. The compression begins only at the point A so that, despite the high air loading pressure, the final compression does not reach a dangerously high value, due to the reduced volume compression ratio.

A special effect may be achieved by providing a second cam lobe 602*a* at the cam 602 at the same circumference (FIG. 8). With the second cam lobe 602*a*, in conjunction with the hydraulic control device according to FIGS. 1 and 2, it is possible to open and close the inlet and the outlet valve at the same time with one turn of the cam 602. The braking power of the four-stroke engine may be increase such that the inlet and the outlet valve are opened and closed once per revolution of the crank shaft.

The lifting curve I of the outlet valve and the lifting curve II of the inlet valve as a function of the crank angle are represented in FIG. 8*a* in accordance with the usual four-stroke cycle. The crank angle begins at the gas-reversing lower dead point position (UT).

FIG. 8*b*, on the other hand, shows the poppet valve controlling effects in the braking mode of the engine. The lifting I of the outlet valve and the lifting II of the inlet valve are represented as a function of the crank angle, again beginning at the gas-reversing lower dead center position (UT). The engine in this case works solely as a compressor. It is shown, that the outlet valve is opened even in the usual compression phase between the gas-reversing lower dead center position (UT) and the ignition upper dead center position (TO). The air is exhausted against a throttle valve in the exhaust duct whereby compression work is being performed. The throttle valve is commonly included in motor brakes, but in known arrangements a braking effect is only achieved during the exhaust phase.

Figure 9A:
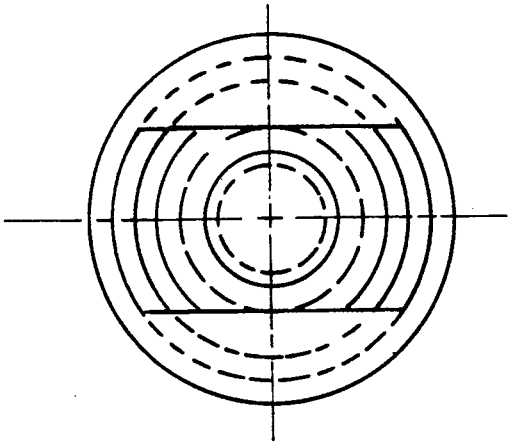
FIG. 9*a* is a cross-sectional view of the square end of the control piston.

A further embodiment (FIG. 9) shows a design for the rotating mechanism of the control piston. The control piston 720 is extended by a piston rod 733, which is provided with a square end 734 (FIG. 9*a*) in the area between the control piston 720 and the roller shaft 703. This square end 734 may be axially moved in a casing 735. The casing 735 is mounted such that it is axially fixed but is connected rotatably to the control cylinder 721. The casing 735 may be rotated in the control cylinder 721 via the lever 736 whereby the control piston 720 is also rotated in the control cylinder 721 via the square end 734 so that the control edges open and close the poppet valve as demonstrated in FIGS. 4–7.

The present invention is, of course, in no way restricted to the specific disclosure of the specification, examples and drawings, but also encompasses any modifications within the scope of the appended claims.

What I claim is:

1. In a hydraulic control device for poppet valves of combustion engines comprising a poppet valve with a valve spring and a hydraulic closed system, formed by a cam input cylinder and a valve-actuating cylinder which are connected by a connecting line, wherein a cam input piston guided in said cam input cylinder is actuated by a cam and a valve-actuating piston guided in said valve-actuating cylinder is functionally connected to said poppet valve, and further comprising a main lubricating device which is connected in parallel to said hydraulic closed system via a relief valve, the improvement wherein:

at least one control unit which is magnetically actuated is provided in a branch circuit of said connecting line, which control unit opens said connecting line to a primary reservoir of said main lubricating device when said poppet valve is closed; and said control unit comprises a control piston and a control cylinder, said control piston being connected to a solenoid, and said control cylinder, in a middle section, being connected via a first control line to said connecting line and via a recycling line to said primary reservoir; with a cylinder volume on top and bottom of said control piston communicating with one another via a compensating line and a restriction; and with said control piston having an annular slot that communicates with a central bore of said control piston with said central bore opening into said bottom cylinder volume such that, via said annular slot and said central bore, a connection of said control line and said recycling line is created when said poppet valve is to be closed and said connection is interrupted when said poppet valve is to be opened.

2. A hydraulic control device according to claim 1, in which two identical control units are provided, with a second one of said control units being connected, in parallel with a first one of said control units, to said connecting line via a second control line, with each of said first and second control units being connectable to said recycling line via a respective restriction; and with said respective solenoids of each of said control units being independently actuatable, with said firs control unit opening said poppet valve and said second control unit closing said poppet valve.

3. A hydraulic control device for poppet valves of combustion engines comprising a poppet valve with a valve spring and a hydraulic closed system, formed by a cam input cylinder and a valve-actuating cylinder which are connected by a connecting line, wherein a cam input piston guided in said cam input cylinder is actuated by a cam and a valve-actuating piston guided in said valve-actuating cylinder is functionally connected to said poppet valve, and further comprising a main lubricating device which is connected in parallel to said hydraulic closed system via a relief valve, the improvement wherein:

said cam input piston serves as a control piston and is provided with a control slot which is connectable via a connecting means of said control piston to a release bore of said control cylinder, which release bore opens to said main lubricating device; with said poppet valve being opened when a bottom of said control piston passes said release bore and said poppet valve being closed when said control slot passes said release bore.

4. A hydraulic control device according to claim 3, in which said control slot of said control piston is slanted in the shape of a helical thread and has a first slanted control edge; with said control slot not extending over the entire circumference, and with a part of said control piston comprising said control slot corresponding to a full piston diameter and a part of said control piston not comprising said control slot having a smaller diameter; with said control piston being adjustable via a rotating mechanism.

5. A hydraulic control device according to claim 4, in which at least two control slots are provided at said control piston, with said first and second control slot being in the shape of a helical thread.

6. A hydraulic control device according to claim 5, in which said control slots have different slants.

7. A hydraulic control device according to claim 4, in which said control piston has a second control edge, which is disposed at said control slot.

8. A hydraulic control device according to claim 7, in which said first and second control edges have different slants.

9. A hydraulic control device according to claim 4, in which said control piston is rotatable about a longitudinal axis thereof via said rotating mechanism in said control cylinder, with said control cylinder being arranged in a housing in a fixed manner and having a portion facing said cam, which portion is enclosed by a rotating casing, with said rotating casing being connected in a non-rotatable manner via a square end of a piston rod to said control piston which control piston is slidable in a direction of said longitudinal axis thereof in said casing, and with a free end of said piston rod being frictionally connected with said roller shaft.

10. A hydraulic control device according to claim 4, wherein said connecting means is in the form of a peripheral recess.

11. A hydraulic control device according to claim 3, wherein said connecting means is in the form of a bore.

* * * * *